US005489130A

United States Patent [19]

Clark

[11] Patent Number: 5,489,130

[45] Date of Patent: Feb. 6, 1996

[54] OVERHEAD DOOR LOCK

[76] Inventor: Ronald L. Clark, 6161 C.R. 207, Millersburg, Ohio 44654

[21] Appl. No.: 182,432

[22] Filed: Jan. 18, 1994

[51] Int. Cl.[6] ..... E05C 5/00

[52] U.S. Cl. ..... 292/66; 292/DIG. 36

[58] Field of Search ..... 292/2, 146, 167, 292/DIG. 36, DIG. 60, 66

[56] References Cited

U.S. PATENT DOCUMENTS

| | | | |
|---|---|---|---|
| 2,124,569 | 7/1938 | Bagley et al. | 292/DIG. 36 |
| 2,124,970 | 7/1938 | Bagley | 292/DIG. 36 |
| 2,375,837 | 5/1945 | Buehner | 292/DIG. 36 |
| 2,886,102 | 5/1959 | Olsen et al. | 292/DIG. 36 |
| 3,163,033 | 12/1964 | Boyles | 292/DIG. 36 |
| 3,863,965 | 2/1975 | Vickers | 292/DIG. 36 |
| 4,739,584 | 4/1988 | Zellman | 49/199 |

*Primary Examiner*—Peter M. Cuomo
*Assistant Examiner*—Tuyet-Phuong Pham
*Attorney, Agent, or Firm*—Sand & Sebolt

[57] ABSTRACT

A overhead door lock which may be used with both manually operated and motor operated doors. The lock has a base adapted to be mounted on the door, and has a mounting plate and a pair of spaced apart legs. Each leg carries a slide aperture, and one leg includes a lockout hole. A striker plate is attached to the door channel in a position collinear with the base. A spring biased striker is carried by the base and when the door is manually operated, the striker is placed in an operative position where it slides freely through generally aligned slide apertures. When the door is motor operated, the striker may be placed in an inoperative lockout position by placing one end of the striker in the lockout hole. When the striker is in the inoperative lockout position, it cannot contact the striker plate when the door is in the closed position. However, the striker may be easily moved to the operative locking position by overcoming the spring bias, and moving the striker into the slide aperture and thus engageable with the striker plate to lock the door in the closed position.

16 Claims, 4 Drawing Sheets

OVERHEAD DOOR LOCK

BACKGROUND OF THE INVENTION

1. Technical Field

The invention relates generally to an improved overhead door lock. More particularly, the invention relates to an improved lock for use with overhead doors which are opened and closed either manually, or via an electric motor. Specifically, the invention relates to an overhead door lock for securing an overhead door in the closed position, but which also may be easily adjusted to place the lock in an inoperative position to allow the door to open and close via an electric motor.

2. Background Information

An ever increasing number of homes are constructed with garages for storing automobiles out of the elements, and for storing yard tools and the like. These garages are generally equipped with overhead doors of a variety of sizes which may be opened and closed over a large doorway. Further, as business becomes increasingly competitive, a growing number of businesses have shipping, storage, and receiving facilities which utilize overhead doors.

While overhead doors are often opened manually, the use of automatic motor operators to lift overhead doors is becoming increasingly popular in both the residential and commercial markets. Further, these motors are a necessity on many commercial overhead doors, as the size and weight of such doors make them cumbersome to be opened by an individual operator.

Whether the door is operated manually or automatically, the weight of the door is generally counterbalanced using either a torsional spring, or an extension spring. A torsional spring is unloaded when the door is in the closed position, and becomes loaded as the door is lifted. Inasmuch as the springs on each side are connected via a torsion rod, a lock is only necessary on one side of the door; but a lock may be provided on each side of the door for added security. However, inasmuch as a door counterbalanced with extension springs is fully loaded when the door is in the closed position, the door requires a lock on each side of the door to prevent the unauthorized entry into the garage area.

When a motor operator is attached to the door, the existing locks must be permanently disengaged as the motor cannot lift the door when the lock is engaged. As such, there has thus far been no simple way for the user of such a door to secure the door in the closed position if for example, the user were to be away from the home or business for some length of time, or if the door is located in a high crime area where further protection may be required. If the user wishes to secure the door incorporating the existing locks, the lock must be reassembled and reinstalled on the door which is both time consuming and labor intensive.

While the existing devices are presumably adequate for the purpose for which they were intended, they presented a number of further drawbacks. Specifically, the prior art devices are not adjustably mounted such that mounting the lock is often a time intensive and tedious task, which substantially increases costs. Moreover, the current locks are designed to accept a cable of a given length, and thus a variety of cable lengths are stocked by the door installer, which further increased operation costs to both the manufacturers of overhead doors, as well as the installers.

Therefore, a need exists for an overhead door lock which may be used with both a torsional and extension spring overhead door, as well as with both manually operated, and motor operated doors. Moreover, the need exists for a lock which may be used with a motor operator and may be releasably moved to a lockout, or disengaged and inoperative position, and which the lock may easily be placed in an operative locking position when the user requires extra security. Moreover, the need exists for a lock which may be installed on doors having a variety of sizes.

SUMMARY OF THE INVENTION

Objectives of the invention include providing an improved lock which may be utilized on a variety of door sizes while utilizing a single length lock cable, and which may be used with both torsion spring doors, and extension spring doors.

A further objective includes providing such a lock which may be temporarily placed in an inoperative or lockout position for use with a motor operator, but which may also be easily moved to an operative position for locking the door when it is closed, for added security.

Another objective is to provide such a lock which is adjustably mounted to the door.

A still further objective is to provide a lock which utilizes an adjustable striker plate for mounting adjacent the door track.

A still further objective is to provide such an overhead door lock which is of simple construction, which achieves the stated objectives in a simple, effective and inexpensive manner, and which solves problems and satisfies needs existing in the art.

These and other objectives and advantages of the invention are obtained by the improved overhead door lock, the general nature of which may be stated as including a base adapted to be mounted to the overhead door; a striker plate adapted to be mounted to the overhead door guide channel; a striker carried by said base and engageable with said striker plate when the door is in the closed position and the striker is in a lock position; and a releasable lockout means, for releasably holding said striker out of engagement with said striker plate.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
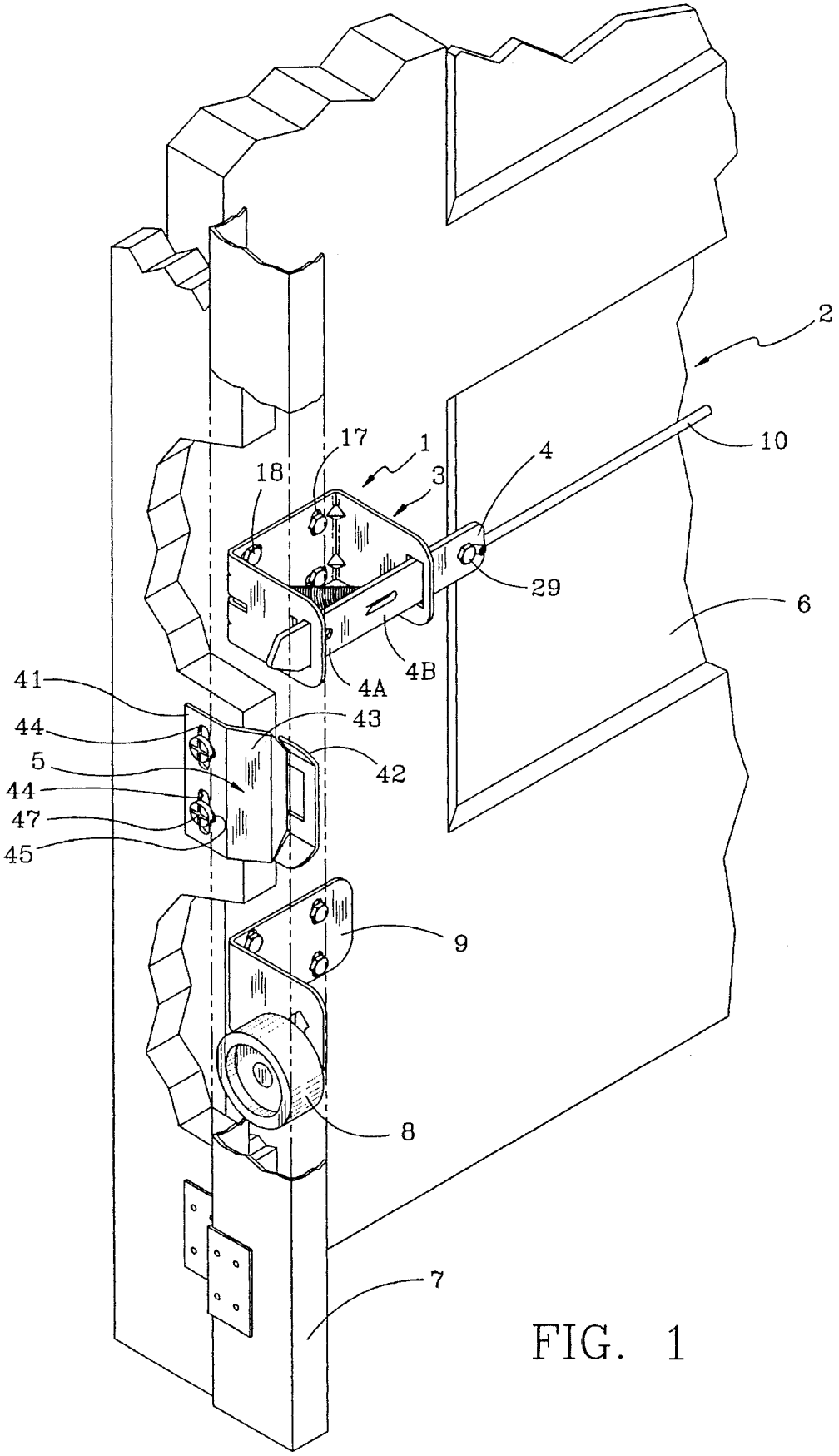
FIG. 1 is a perspective view of the overhead door lock shown attached to an overhead door and track, with portions of the track and door broken away and other portions in dot-dash lines.

The overhead door lock of the present invention is indicated generally at 1 in FIG. 1, and is shown in combination with an overhead door assembly indicated generally at 2. Overhead door lock 1 includes a base indicated generally at 3, a striker 4 and a striker plate indicated generally at 5. Striker 4 includes two central portions 4A and 4B each of which presents a different cross-section. Central portion 4A is defined by height $H_1$ on FIG. 9 and width $W_1$ on FIG. 2. Similarly, central portion 4B has a height $H_1$ but provides a width $W_2$ shown on FIG. 2.

Overhead door assembly 2 generally includes a door 6 which moves between a pair of guide channels 7 (one shown), via the rolling connection of channels 7 with a plurality of rollers 8 (one shown). Rollers 8 are each supported by a respective mounting bracket 9. Door 6 also includes a cable 10 with a first end attached to striker 4, and a second end (not shown) attached to a handle (not shown) located centrally on door 6. In operation, roller 8 moves within guide channels 7 as door 6 is opened and closed as is well known in the art.

Figure 2:
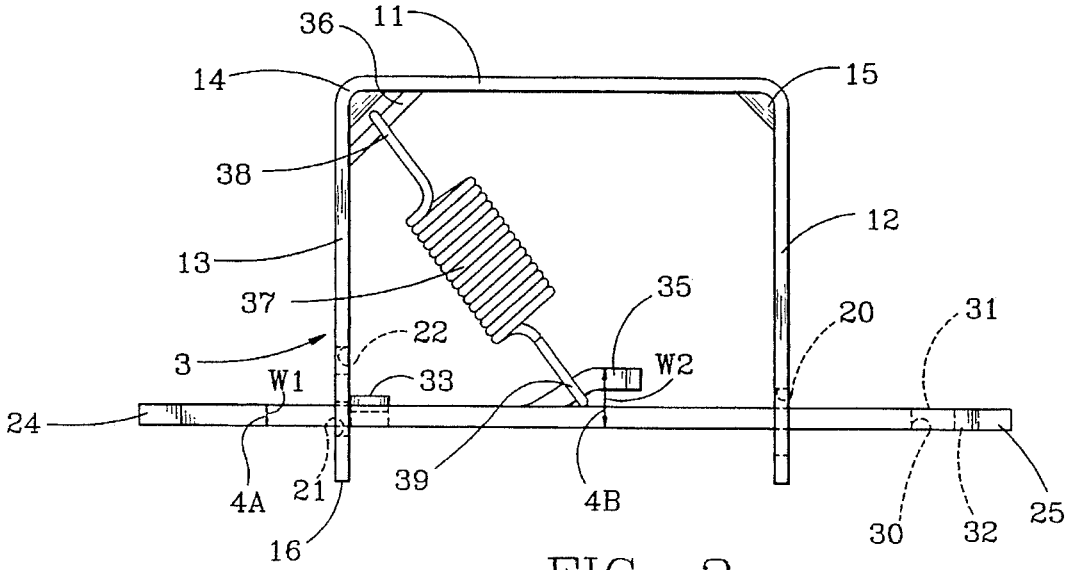
FIG. 2 is a top plan view of the lock of the present invention.
Figure 4:
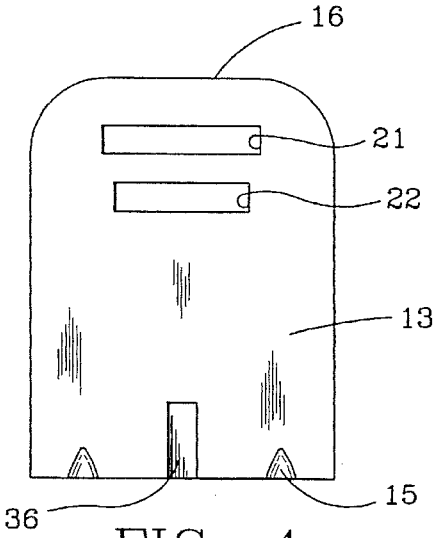
FIG. 4 is a right side elevational view of the lock of FIG. 2 with the striker removed.
Figure 3:
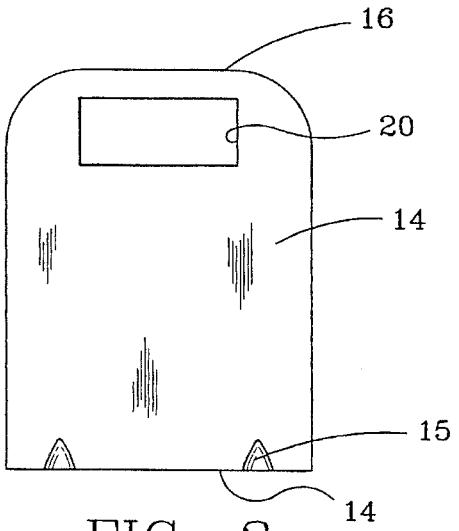
FIG. 3 is a left side elevational view of the lock of FIG. 2 with the striker removed.

In accordance with one of the main features of the invention, and referring to FIGS. 2–4, base 3 is substantially C-shaped and includes a mounting plate 11, and a pair of spaced parallel legs 12 and 13. Preferably, legs 12 and 13 are normal in relation to mounting plate 11, and are integrally formed therewith. Each leg 12 and 13 joins plate 11 at a respective corner 14, which corners include a plurality of strengthening ribs 15. Each leg 12 and 13 also includes a respective free end 16. A plurality of elongated mounting holes 17 (FIG. 9) extend through mounting plate 11 which allow adjustment of base 3 in both the horizontal and vertical directions when mounted on door 6. A respective mounting bolt 18 (FIG. 1) passes through each hole 17, and is tightened to secure base 3 to door 6 (FIGS. 1 and 9).

Leg 12 includes a substantially rectangular shaped hole 20 which slidably accepts striker 4, and has a cross-section larger than that of central portion 4B of striker 4 and thus the width of hole 20 is greater than width $W_2$ (FIG. 3). Leg 13 includes a slide aperture 21 which also slidably accepts striker 4 and thus is larger than the cross-section of central portion 4A of striker 4 and has a height greater than height $H_1$ and a width greater than width $W_1$ (FIG. 4). However, in accordance with one of the main features of the present invention, leg 13 also includes a lockout aperture 22 which is smaller than the cross-section of central portion 4A of striker 4 and specifically, the height of lockout aperture 22 is smaller than height $H_1$, the purpose for which will be described in detail hereinbelow.

Figure 9:
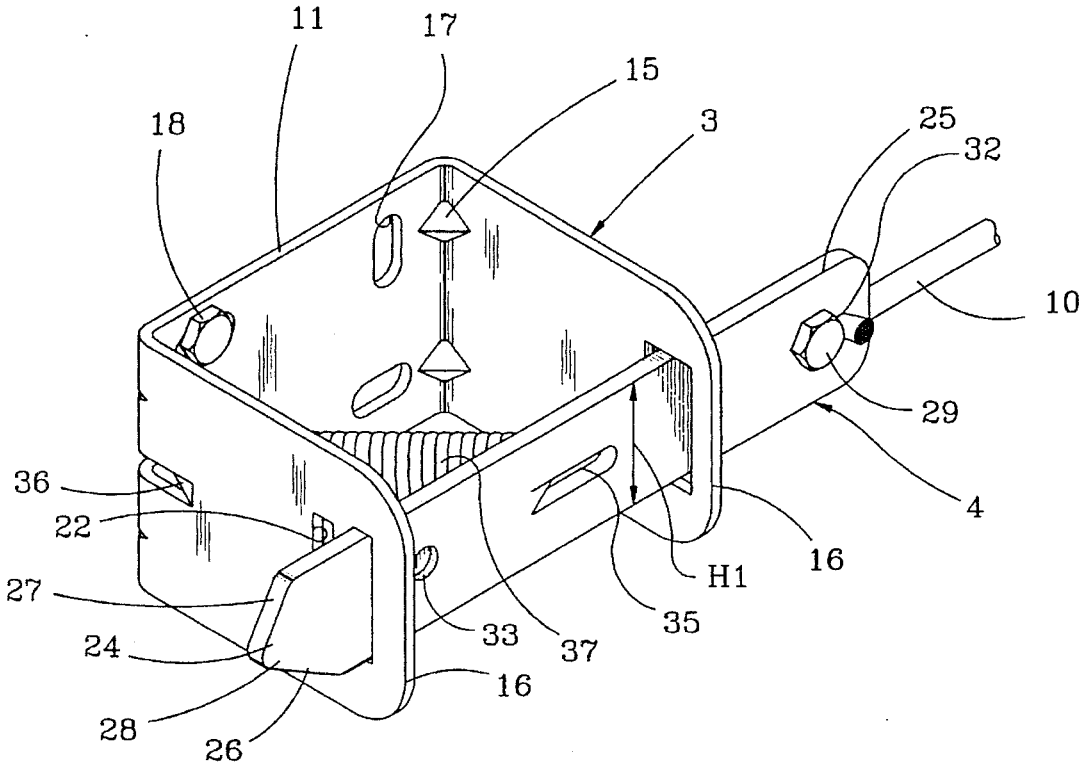
FIG. 9 is a perspective view of the lock of the present invention with the striker in the operative locking position.

Referring to FIGS. 2 and 9, striker 4 is a substantially flat rectangular bar and includes a first end 24 and a second end 25. First end 24 includes a lower cam edge 26 and an upper cam edge 27. Edges 26 and 27 meet at end 24, and as such, end 24 is substantially arrowhead shaped terminating at a point 28. End 24 thus has a constantly increasing cross section extending from point 28 to central portion 4A.

End 25 includes a key-shaped hole 30 which includes a first diameter portion 31 sized to accept a fastener 29 (FIG. 9), and a smaller second diameter portion 32, having a diameter substantially equal to cable 10. Fastener 29 extends through portion 31 to clamp cable 10 into portion 32 and thus secure it to striker 4.

A spring retainer 35 extends into C-shaped base 3 from striker 4 at central portion 4B. Spring retainer 35 and striker 4 thus define width $W_2$ (FIG. 2–3). Preferably, retainer 35 is stamped out of striker 4. A spring clip 36 extends diagonally between mounting plate 11 and leg 13, and is preferably formed by punching a strip of metal from corner 14. A coil spring 37 having a pair of hooked ends 38 and 39 extends between striker 4 and mounting plate 11 such that hooked end 38 extends around spring clip 36, and hooked end 39 extends around spring retainer 35. Spring 37 should be of such a size as to constantly bias striker 4 toward leg 13. In the preferred embodiment, spring 37 is helical; however, other type springs could be utilized without departing from the spirit of the present invention.

A stop 33 is stamped out of striker 4, and extends toward mounting plate 11. The cross section of striker 4, if taken through stop 33, is greater than slide aperture 21, and thus stop 33 contacts leg 13 near slide aperture 21, thus defining the limit of movement of striker 4 through slide aperture 21 and assuring that a constant force is imparted on striker 4 via spring 37. Spring 37 also biases striker 4 toward base 11, causing retainer 35 to contact leg 12 adjacent hole 20 thus defining a second limit of motion for striker 4 through slide aperture 21. Inasmuch as the cross section of central portion 4B, is smaller than that of hole 20, an upward force may be applied to end 25 of striker 4 and striker 4 may be pulled through hole 20. In this manner, striker 4 may pass through hole 20 for purposes which will be described in detail hereinbelow. However, spring retainer 35 must be positioned apart from leg 12 when mounted within base 3 to permit striker 4 to slide within hole 20 and aperture 21 before retainer 35 contacts leg 12.

Figure 5:
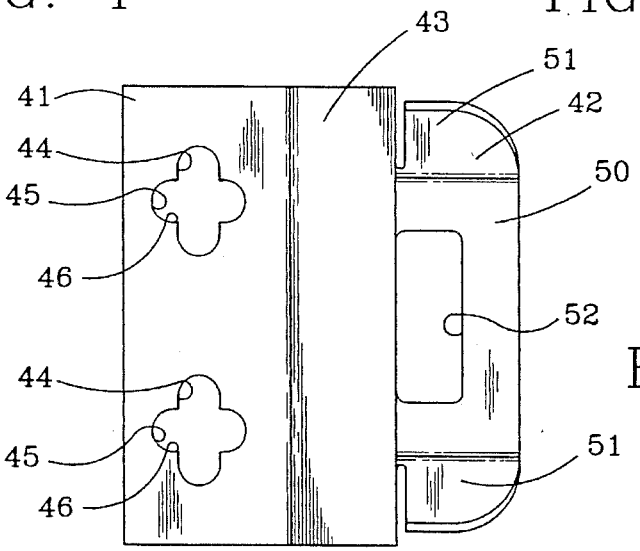
FIG. 5 is a side elevational view of the striker plate of FIG. 1.

Referring to FIGS. 1 and 5, striker plate 5 includes a mounting lip 41, and a cam plate 42. Mounting lip 41 and cam plate 42 are joined by a center plate 43. In accordance with the invention, mounting lip 41 includes a pair of vertical first slots 44, which slots are intersected by a pair of horizontal second slots 45 such that first slots 44 and second slots 45 intersect and form a pair of substantially cross-shaped slots 46 which accept a respective mounting bolt 47 (FIG. 1). Cam plate 42 includes a lock plate 50 integrally formed with a pair of camming plates 51 extending outwardly from the sides of lock plate 50. Lock plate 50 includes a locking hole 52 which is somewhat larger than the central portion 4A of striker 4, and accepts striker 4 when door 6 is in the closed position.

When lock 1 is installed, bolts 18 (FIG. 1) are passed through elongated slots 17 to mount base 3 to door 6. Before bolts 18 are tightened, but while they are engaging door 6, base 3 is adjusted to the specifications required for that specific door. The adjustment is possible as elongated holes 17 loosely engage mounting bolts 18, and as base 3 is moved with respect to bolts 18, each hole 17 may move with relation to a respective bolt 18 thereby securing base 3 in the proper adjusted position with respect to door 6. Striker plate 5 is installed on guide channel 7, and is also adjustably mounted thereto via the interaction of mounting bolts 47 and cross-shaped slots 46.

Figure 10:
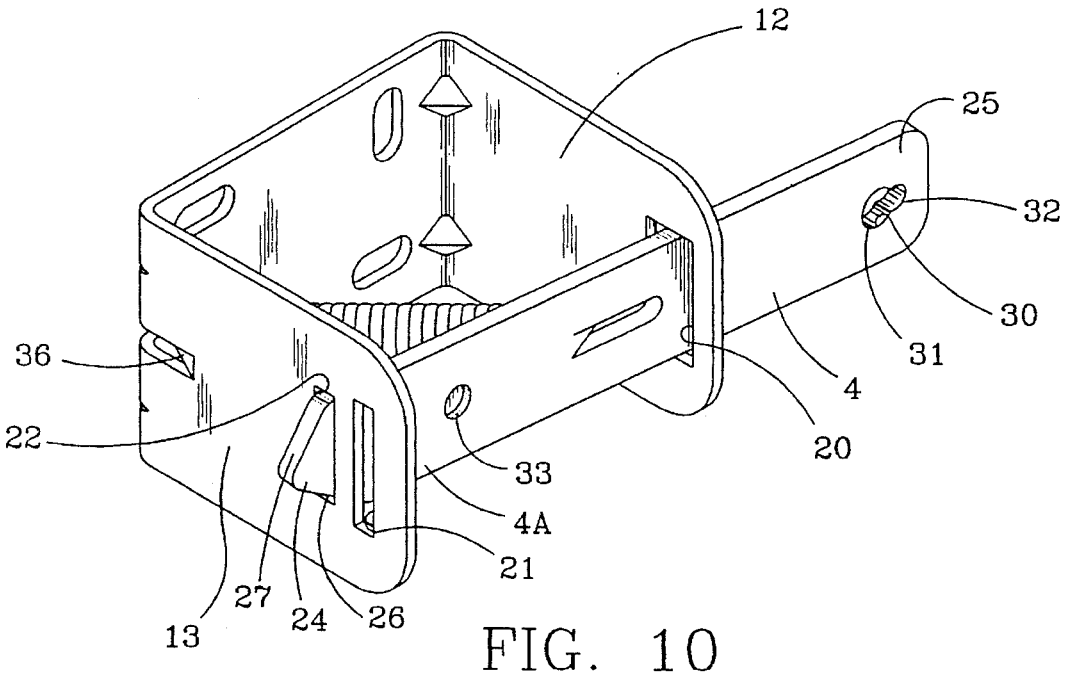
FIG. 10 is a perspective view similar to FIG. 9 of the lock with the striker in the inoperative lockout position.

Regardless of whether lock 1 is utilized with a manually operated door or a motor operated door, cable 10 is held within second diameter portion 32 of key-shaped hole 30 with a fastener 29 installed within first diameter portion 31. However, when lock 1 is utilized with a motor operated door, cable 10 is slacked when end 24 is pressed within lockout aperture 22 as discussed in more detail below. When striker 4 is moved back to the locked or operative position, the slack in cable 10 will be taken up by the movement of striker 4 such that the handle (not shown) may be operated to disengage the lock 1. Similarly, if a motor operator is retrofitted to an existing installation, cable 10 is slacked when striker 4 is moved to the inoperative or lockout position as shown in FIG. 10.

Figure 6:
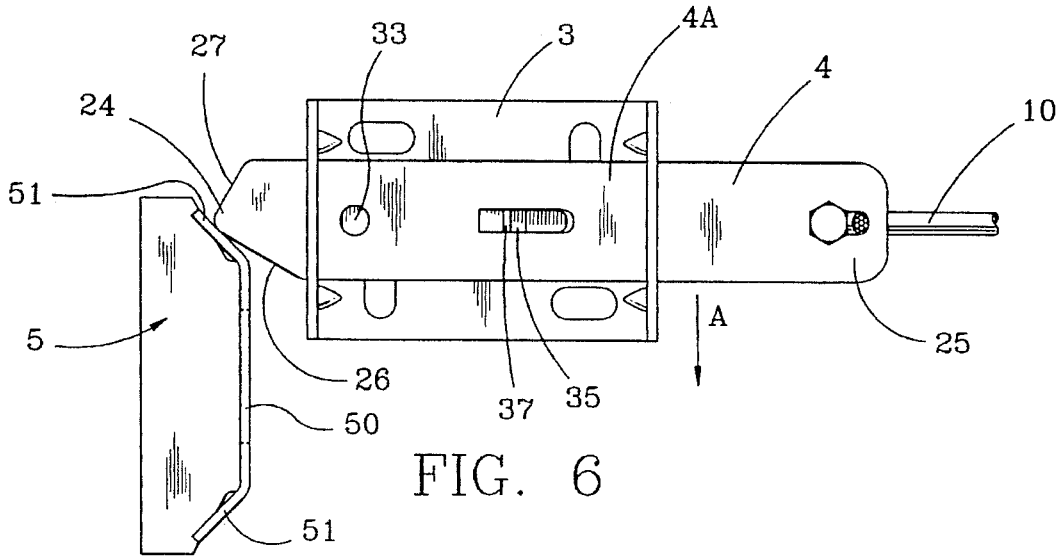
FIG. 6 is a front elevational view of the lock and striker plate in an unlocked operative position.
Figure 7:
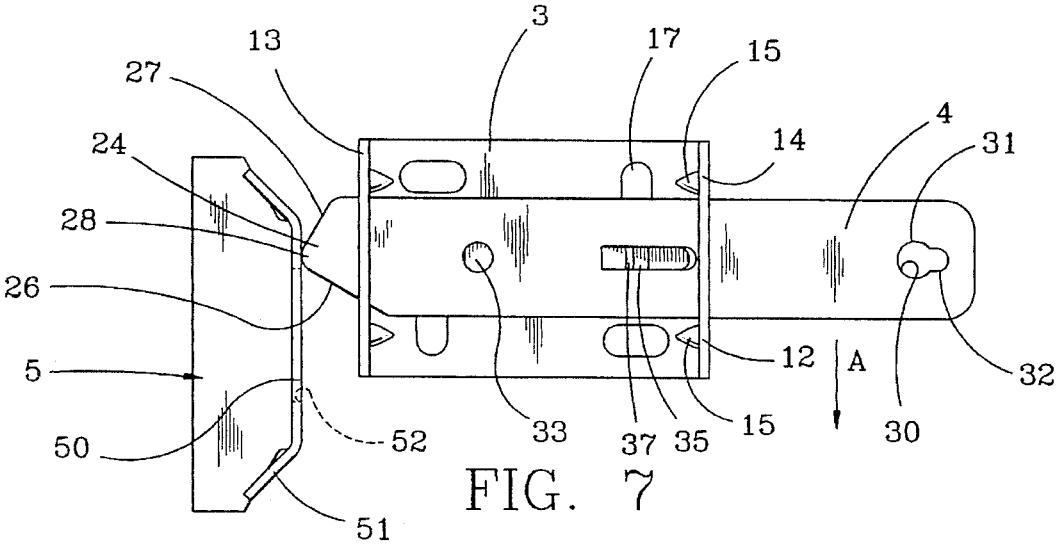
FIG. 7 is a front elevational view of the lock and striker plate of FIG. 6 in an intermediate position.
Figure 8:
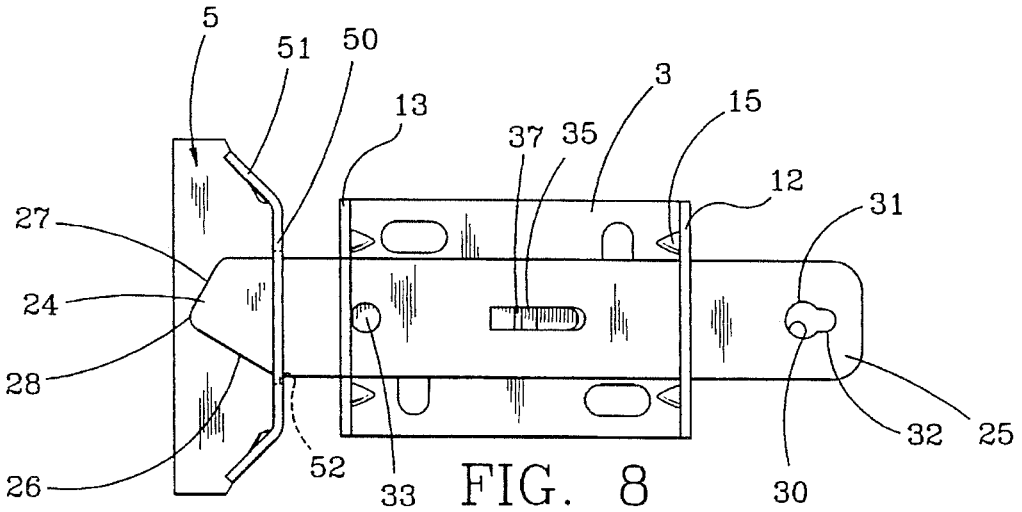
FIG. 8 is a front elevational view of the lock and striker plate of FIGS. 6 and 7 in a locked position.

Referring to FIGS. 6–8, when lock 1 is utilized with a manually operated door, lower cam edge 26 of striker 4 first contacts camming plate 51. As door 6 continues to move toward the closed position in the direction of arrow A, lock 1 moves to the position shown in FIG. 7. Specifically, the camming action between camming plate 51 and cam edge 26 applies a force on striker 4 against the resistance of spring 37 such that striker 4 slides within slide aperture 21 and hole 20 until point 28 is in contact with lock plate 50. When striker 4 is in the position shown in FIG. 7, spring retainer 35 stops the travel of striker 4 via its abutting engagement with leg 12. As such, spring retainer 35 is positioned on striker 4 such that point 28 will cam up camming plate 51 and into locking hole 52 before spring retainer 35 contacts leg 12 to forestall striker 4 from continued movement.

Lastly, when door 6 is in the fully closed position (FIG. 8), first end 24 of striker 4 will pass through locking hole 52 and lock door 6 in the closed position. Spring 37 provides the force necessary to bias striker 4 through locking hole 52 after upper cam edge 27 passes therethrough. The continued movement of striker 4 through slide aperture 21 and into locking hole 52 is forestalled by the abutting engagement between stop 33 and leg 13. As such, the distance which striker 4 extends into locking hole 52 is determined by the position of stop 33 on striker 4.

When the user wishes to reopen door 6, a force is applied to cable 10 which pulls striker 4 out of engagement with locking hole 52, leaving the user free to open door 6. As should be apparent to one in the art, the position of stop 33 may be varied to increase or decrease the stroke of striker 4 without departing from the spirit of the present invention.

The lock in FIG. 9 thus shows the position of lock 1 when in the operative position for use on a manually operated door. Specifically, cable 10 is shown attached to striker 4 and striker 4 is freely slidably mounted in hole 20 and aperture 21. When striker 4 is so mounted, the distance striker 4 extends into locking hole 52 is dictated by the distance stop 33 extends from leg 13 as the abutting engagement between stop 33 and leg 13 that prevents the continued movement of striker 4 into locking hole 52. Similarly, when the striker is in contact with lock plate 50, spring retainer 35 contacts leg 12 to prevent continued movement of the striker.

Conversely, when the motor operator (not shown) is installed, striker for must be moved to the inoperative or lockout position as shown in FIG. 10. A force must be applied against the second end 25 of striker 4 to overcome spring 37. Inasmuch as hole 20 is larger than the cross-section of central portion 4B, striker 4 will pass through hole 20 and first end 24 will be completely withdrawn from aperture 21. Thereafter, first end 24 may be placed within lockout aperture 22 which is smaller than central portion 4A, but which permits a portion of arrowhead-shaped first end 24 to pass therethrough. Arrowhead-shaped first end 24 is thus wedged into lockout aperture 22 when the camming surfaces 26 and 27 contact the sides of lockout aperture 22 and prevent the continued movement of striker 4 therethrough. When striker 4 is in this inoperative position, it will not contact striker plate 5 when door 6 is opened and closed thus allowing the motor operator to manipulate door 6 without interference.

Thus, as shown in FIG. 1, lock 1 is attached to a door and spring biased striker 4 automatically engages striker plate 5 to lock manually operated door 6 in the closed position. Moreover, lock 1 provides a lockout aperture 22 into which the striker is wedged to place the striker in an inoperative position to prevent the striker from contacting the striker plate when the door is driven via a motor operator between open and closed positions.

However, the user need only remove the striker from aperture 21 and replace it within aperture 22 to place striker 4 in a locked position with plate 5 to provide an extra measure of security to the motor operated door when in the closed position.

Accordingly, the improved overhead door lock is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved overhead door lock is constructed and used, the characteristics of the construction, and the advantageous, new and useful results obtained; the new and useful structures, devices, elements, arrangements, parts and combinations, are set forth in the appended claims.

I claim:

1. A lock for locking an overhead door supported within a pair of guide channels and movable between open and closed positions comprising:

a base adapted to be mounted to the overhead door;

a striker plate adapted to be mounted to at least one of the overhead door guide channels;

a striker carried by the base and movable between an operative locking position and an inoperative lockout position, the striker being engageable with the striker plate and adapted to lock the door in the closed position when the striker is in the operative position; and lockout means formed in the base for releasably and selectively holding the striker in the inoperative position preventing the striker from engaging the striker plate regardless of the movement of the overhead door relative to the guide channels, whereby the striker must be disassociated from the lockout means to move from the inoperative to the operative position.

2. A door lock as defined in claim 1 further comprising a spring means for biasing the striker toward the striker plate.

3. A door lock as defined in claim 2 in which the spring means comprises a spring mounted between the base and the striker.

4. A door lock as defined in claim 1 in which the base is substantially C-shaped having a mounting plate, and a pair of substantially parallel spaced apart legs extending outwardly from the mounting plate.

5. A door lock as defined in claim 4 in which one of the legs includes a first slide aperture and the other of the legs includes a second slide aperture, and in which the first and second slide apertures slidably support the striker on the base when the striker is in the operative position.

6. A door lock as defined in claim 5 in which the striker includes a spring retainer means for securing a spring to the striker; and in which the spring retainer means contacts one leg of the base adjacent the first slide aperture when a predefined limit of travel of the striker is reached, thus preventing the striker from passing completely through the first slide aperture in the base.

7. A door lock as defined in claim 6 in which the spring retainer means extends from the striker towards the mounting plate of the base.

8. A door lock as defined in claim 5 in which a stop extends from the striker and is engageable with one leg of the base adjacent the second slide aperture to prevent the striker from passing completely through the second slide aperture.

9. A door lock as defined in claim 4 including adjustment means on the base for adjustably mounting the base to the door.

10. A door lock as defined in claim 9 in which the adjustment means includes a plurality of elongated mounting holes extending through the mounting base, and in which the holes accept a fastener means for securing the base to the door and which allow adjustment of the base with respect to the door.

11. A door lock as defined in claim 4 including adjustment means on the striker plate for adjustably mounting the striker plate to the guide channel.

12. A door lock as defined in claim 11 in which the adjustment means includes a plurality of cross-shaped slots, and in which the slots accept a fastener means for securing the striker plate to the channel and which cross-shaped slots allow the striker plate to be both vertically and horizontally adjusted with respect to the guide channel with the fastener means adapted to remain stationary relative to the guide channel.

13. A door lock as defined in claim 1 in which the striker is formed with a key-hole shaped hole with a first diameter portion and a second diameter portion communicating with the first portion, which second portion is adapted to accept a cable, and which first portion accepts a fastener means for securing the cable in the second portion.

14. A door lock as defined in claim 1 in which the base is a single piece of metal.

15. A lock for locking an overhead door supported within a pair of guide channels and movable between open and closed positions comprising:

a substantially C-shaped base having a mounting plate, and a pair of substantially parallel spaced apart legs extending outwardly from the mounting plate;

a striker plate adapted to be mounted to at least one of the overhead door guide channels;

a striker carried by the base and movable between an operative locking position and an inoperative lockout position, the striker being engageable with the striker plate and adapted to lock the door in the closed position when the striker is in the operative position; and lockout means formed in the base for releasably holding the striker in the inoperative position preventing the striker from engaging the striker plate, whereby the lockout means includes an aperture extending through one of the legs, and in which the aperture is smaller than a cross section of the striker such that the striker cannot extend therethrough when the striker is in the inoperative lockout position.

16. A lock for locking an overhead door supported within a pair of guide channels and movable between open and closed positions comprising:

a base adapted to be mounted to the overhead door;

a striker plate adapted to be mounted to at least one of the overhead door guide channels;

a striker carried by the base and movable between an operative locking position and an inoperative lockout position, the striker being engageable with the strike plate and adapted to lock the door in the closed position when the striker is in the operative position; and a keyhole shaped hole formed in the striker with a first diameter portion and a second diameter portion, communicating with the first diameter portion, which second portion is adapted to accept a cable, and which first portion accepts a fastener means adapted for securing the cable in the second portion.

* * * * *